US007861948B1

(12) United States Patent
Crooks

(10) Patent No.: US 7,861,948 B1
(45) **Date of Patent: *Jan. 4, 2011**

(54) ADJUSTABLE ARC ROTOR-TYPE SPRINKLER WITH SELECTABLE UNI-DIRECTIONAL FULL CIRCLE NOZZLE ROTATION

(75) Inventor: John D. Crooks, San Diego, CA (US)

(73) Assignee: Hunter Industries, Inc., San Marcos, CA (US)

( * ) Notice: Subject to any disclaimer, the term of this patent is extended or adjusted under 35 U.S.C. 154(b) by 422 days.

This patent is subject to a terminal disclaimer.

(21) Appl. No.: 11/612,801

(22) Filed: Dec. 19, 2006

Related U.S. Application Data

(63) Continuation-in-part of application No. 11/139,725, filed on May 27, 2005, now Pat. No. 7,287,711.

(51) Int. Cl.
*B05B 3/04* (2006.01)
*B05B 3/16* (2006.01)

(52) U.S. Cl. ..... 239/237; 239/73; 239/240; 239/242; 239/263; 239/263.3; 239/381

(58) Field of Classification Search ..... 239/71, 239/73, 200–207, 240, 242, 247, 263.3, 237, 239/246, 263, 264, 380, 381, DIG. 1, DIG. 15
See application file for complete search history.

(56) References Cited

U.S. PATENT DOCUMENTS

| | | | | |
|---|---|---|---|---|
| 3,107,056 | A | 10/1963 | Hunter | |
| 4,568,024 | A | 2/1986 | Hunter | 239/242 |
| 4,624,412 | A | 11/1986 | Hunter | 239/232 |
| 4,625,914 | A | 12/1986 | Sexton et al. | 239/206 |
| 4,634,052 | A | 1/1987 | Grizzle et al. | 239/205 |
| 4,718,605 | A | 1/1988 | Hunter | 239/242 |
| 4,784,325 | A | 11/1988 | Walker et al. | 239/204 |
| 4,787,558 | A | 11/1988 | Sexton et al. | 239/205 |
| 4,892,252 | A | 1/1990 | Bruninga | 239/205 |
| 4,901,924 | A | 2/1990 | Kah, Jr. | 239/242 |
| 4,948,052 | A | 8/1990 | Hunter | 239/242 |
| 4,972,993 | A | 11/1990 | Van Leeuwen | 239/205 |
| 5,048,757 | A | 9/1991 | Van Leeuwen | 239/205 |
| 5,148,991 | A * | 9/1992 | Kah, Jr. | 239/242 |
| 5,383,600 | A | 1/1995 | Verbera et al. | 239/205 |
| 6,042,021 | A | 3/2000 | Clark | 239/205 |
| 6,050,502 | A | 4/2000 | Clark | 239/237 |
| 6,732,950 | B2 | 5/2004 | Ingham, Jr. et al. | 239/205 |
| 6,869,026 | B2 | 3/2005 | McKenzie et al. | 239/237 |
| 6,945,471 | B2 | 9/2005 | McKenzie et al. | 239/237 |
| 7,028,920 | B2 | 4/2006 | Hekman et al. | 239/240 |
| 2004/0195358 | A1 | 10/2004 | Santiago et al. | 239/200 |

* cited by examiner

*Primary Examiner*—Jason J Boeckmann
(74) *Attorney, Agent, or Firm*—Michael H. Jester

(57) ABSTRACT

A sprinkler includes a drive mechanism mounted in a riser that rotates a nozzle at the top of the riser. The drive mechanism enables a user to select between oscillation of the nozzle through an adjustable arc and uni-directional full circle rotation of the nozzle. The sprinkler includes an automatic arc return feature that enables the nozzle to resume oscillation between a pair of original pre-set arc limits when the nozzle is twisted by a vandal outside of the arc limits.

16 Claims, 15 Drawing Sheets

ADJUSTABLE ARC ROTOR-TYPE SPRINKLER WITH SELECTABLE UNI-DIRECTIONAL FULL CIRCLE NOZZLE ROTATION

CROSS-REFERENCE TO RELATED APPLICATION

This application is a continuation-in-part of U.S. patent application Ser. No. 11/139,725 filed May 27, 2005 now U.S. Pat. No. 7,287,711 and claims priority from the filing date of said prior application.

BACKGROUND

Irrigation sprinklers for turf and landscaping include spray, impact, and rotor-type sprinklers. The latter are desirable where large areas of uniform coverage are desired. Edwin J. Hunter was the pioneer of gear driven adjustable arc rotor-type sprinklers. Made largely of injection molded plastic parts, a pop-up oscillating rotor-type sprinkler typically includes a riser which telescopes within an outer housing and enclosing a turbine that rotates a nozzle through a gear train and reversing mechanism. The position of one of two arc tabs or stops can be manually moved, usually with a special tool, to adjust the arc of oscillation. In some cases, an adjustable arc rotor-type sprinkler is equipped with an automatic arc return feature so that the nozzle will resume oscillation between its pre-set arc limits after a vandal has twisted the riser. This prevents watering of sidewalks, patios and other areas besides landscaping, thereby avoiding wasting of water and safety hazards. The nozzle is usually replaceable to achieve the desired trajectory and/or flow rate in gallons per minute. Rotor-type sprinklers used in golf courses often include pneumatically actuated or solenoid-operated valves.

SUMMARY OF THE INVENTION

It would be desirable to have an arc adjustable rotor-type sprinkler that could readily be converted in the field to uni-directional full circle rotation. This would enable maximum coverage during a watering cycle. Such full circle watering could also be advantageous in preventing frost damage and in allowing tangential nozzle thrust to assist or retard the gear drive. Heretofore an adjustable arc rotor-type sprinkler has not been developed that will allow such ready conversion inexpensively, without undue complexity and with reliability. Avoiding the usage of the reversing mechanism during full circle nozzle rotation would have the added benefit of reducing wear on those parts so they would have a longer life available for subsequent oscillating motion of the nozzle between pre-set arc limits.

In accordance with an embodiment of the invention, a sprinkler includes a drive mechanism mounted in a riser that rotates a nozzle at the top of the riser. The drive mechanism enables a user to select between oscillation of the nozzle through an adjustable arc and uni-directional full circle rotation of the nozzle. The sprinkler can optionally include an automatic arc return feature that enables the nozzle to resume oscillation between a pair of original pre-set arc limits when the nozzle is twisted by a vandal outside of the arc limits.

DETAILED DESCRIPTION

In accordance with the invention, a pop-up rotor-type sprinkler 10 incorporates arc adjustment and planetary gear reversal mechanisms of a type well known to those skilled in the art of sprinkler design. See for example, U.S. Pat. Nos. 3,107,056; 4,568,024; 4,624,412; 4,718,605; and 4,948,052 of Edwin J. Hunter, the entire disclosures of which are hereby incorporated by reference. Alternately, the reversal mechanism may comprise one or more ports with a movable member to divert water flow to change the direction of rotation of the nozzle. See U.S. Pat. No. 4,625,914 of Sexton et al. The reversal mechanism may be located in the riser with the drive mechanism, or separate from the drive mechanism in a nozzle head as disclosed in U.S. Pat. No. 6,050,502 of Mike Clark.

Figure 1:
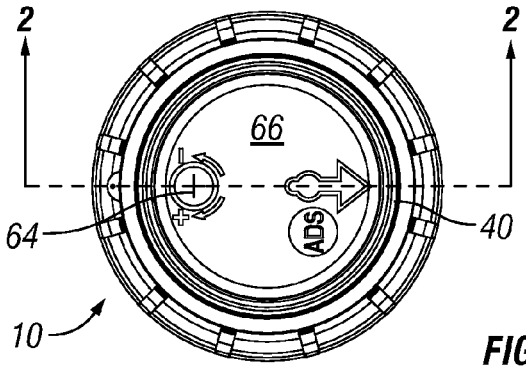
FIG. 1 is a top plan view of a rotor-type sprinkler in accordance with an embodiment of the present invention.
Figure 2:
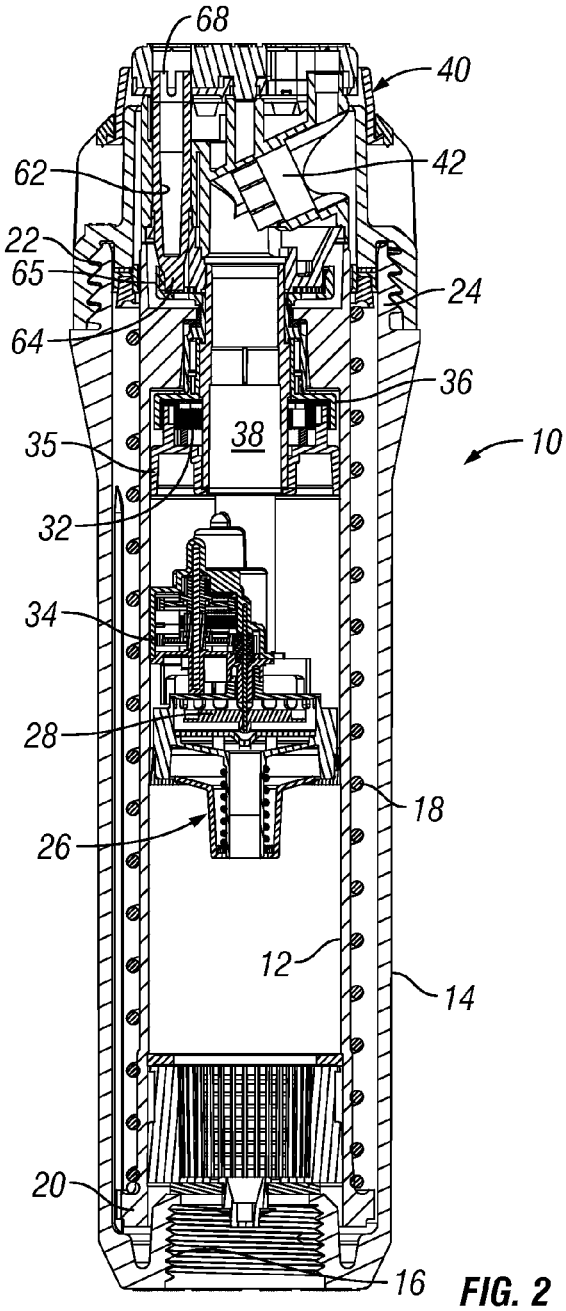
FIG. 2 is a vertical sectional view of the sprinkler of FIG. 1 taken along line 2-2 of FIG. 1.

Referring to FIGS. 1 and 2, in accordance with an embodiment of the invention, a pop-up rotor-type sprinkler 10 includes an inner cylindrical riser 12 that extends telescopically within a surrounding cylindrical outer housing 14. The outer housing 14 has a female threaded lower inlet 16 that screws over a male threaded riser (not illustrated) connected to a subterranean PVC water supply line. The riser 12 is normally held in its retracted position by surrounding coil spring 18 compressed between a lower flange 20 of the riser 12 and a female male threaded cylindrical top cap 22 screwed over the male threaded upper end 24 of the outer housing 14. When pressurized water enters the riser 12 through inlet 16 the riser telescopes to its extended position. Water flows into the riser 12 via spring-operated regulator valve 26 which ensures that turbine 28 is driven in a predetermined speed range. The turbine 28 drives a small gear 30*c* (FIG. 5) of a reversing mechanism 32 through a gear train reduction 34 (FIG. 2). The reversing mechanism 32 is mounted above a partition 35 (FIGS. 3 and 4) and includes a set of planetary gears 30*a*, 30*b*, 30*c* and 30*d* (FIGS. 5 and 6) that rock back and forth so that gears 30*a* and 30*d* alternately engage and drive a bull gear assembly 36 in opposite directions. Bull gear assembly 36 turns a hollow drive shaft 38. The hollow drive shaft 38 has external teeth or splines that fit within splines formed on an inner cylindrical extension of the bull gear assembly 36.

Referring still to FIG. 2, a cylindrical head or turret 40 is mounted to the upper end of the hollow drive shaft 38 for rotation at the upper end of the riser 12. The turret 40 encloses a removable nozzle 42 that ejects a stream of water that is conveyed through the hollow drive shaft 38.

Figure 4:
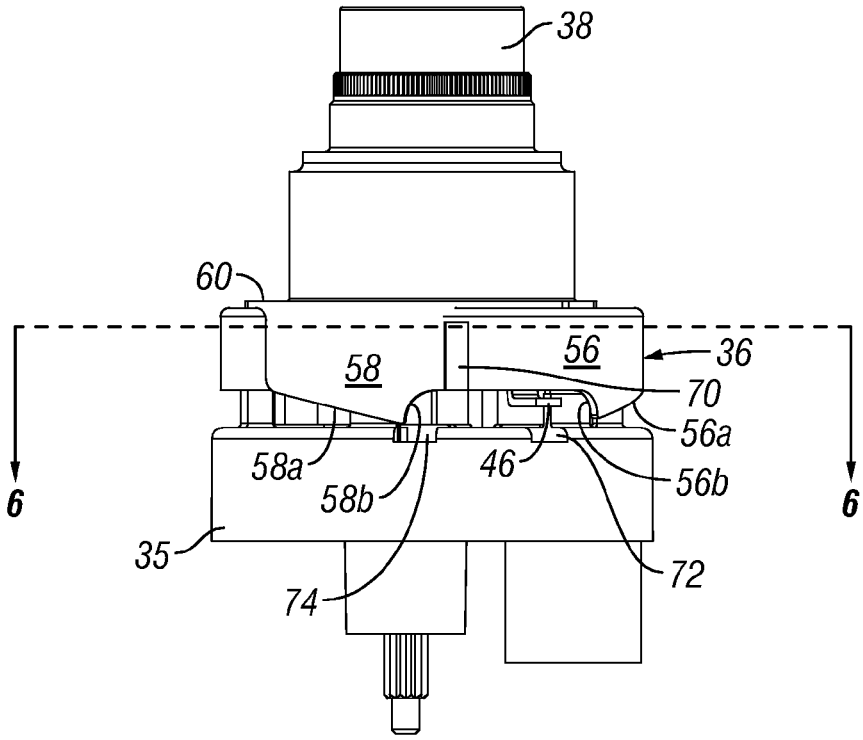
Figure 5:
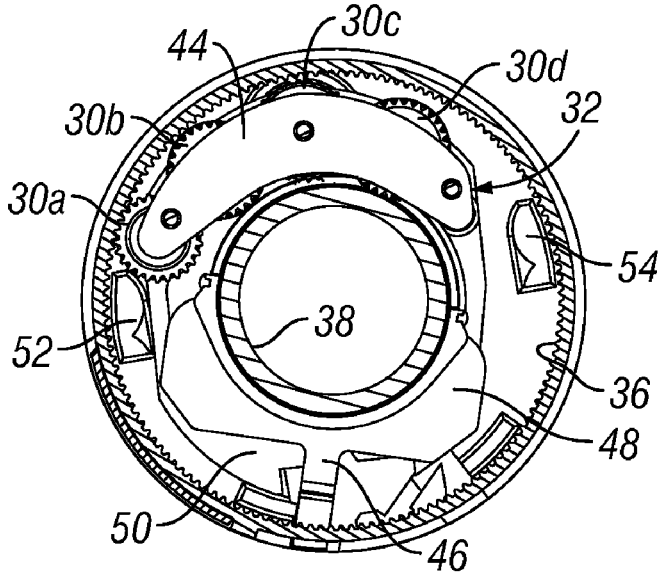
FIGS. 5 and 6 are horizontal sectional views taken along lines 5-5 of FIGS. 3 and 6-6 of FIG. 4, respectively, illustrating the position of the reversing mechanism during counter-clockwise and clockwise rotation, respectively, of the nozzle.
Figure 6:
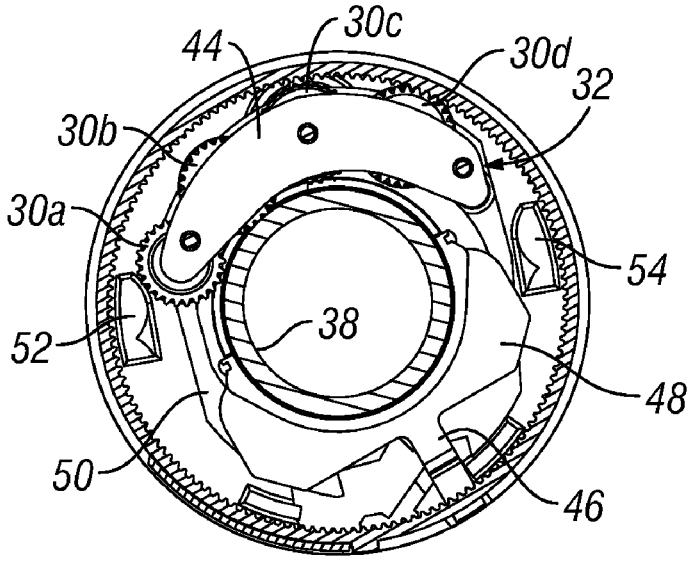

Referring to FIG. 5, the reversing mechanism 32 includes upper arm 44 and lower arm (not visible) which carry the axles of the planetary gears 30*a*, 30*b*, 30*c* and 30*d* in such a fashion that they are engaged with each other. The reversing mechanism 32 further includes a resilient flexible shift dog 46 that extends from a shift dog plate 48 that extends around opposite sides of the hollow drive shaft 38. Reversing mechanism 32 further includes a yoke 50 that is moved back and forth by the shift dog 46 to pivot the reversing mechanism 32 about the axle of gear 30*c*. The reversing mechanism 32 is biased over-center by U-shaped springs (not illustrated) made of thin folded sheet steel that are compressed between posts 52 and 54 and shoulders (not illustrated) that project upwardly from the shift dog plate 48. See FIG. 4 of U.S. Pat. No. 6,042,021 of Mike Clark granted Mar. 28, 2000, the entire disclosure of which is hereby incorporated by reference. The folded steel springs ensure that the reversing mechanism 32 will positively shift between the two orientations illustrated in FIGS. 5 and 6 and will not stall in an intermediate orientation.

Figure 3:
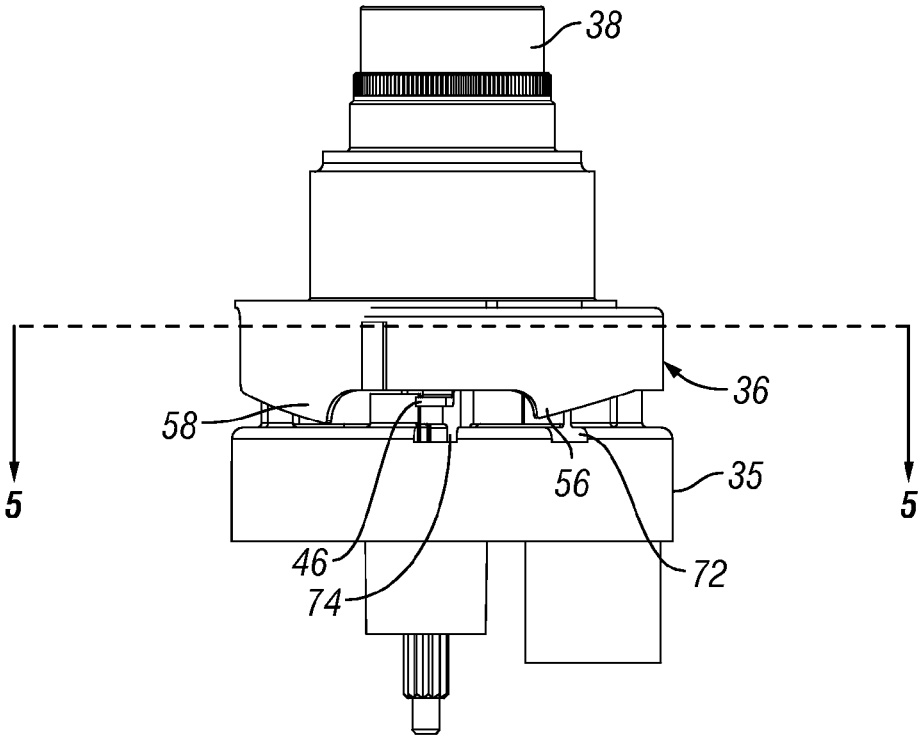
FIGS. 3 and 4 are enlarged side elevation views of the bull gear assembly of the sprinkler of FIG. 1 with its movable arc tab positioned for oscillating the nozzle between pre-set arc limits.
Figure 8:
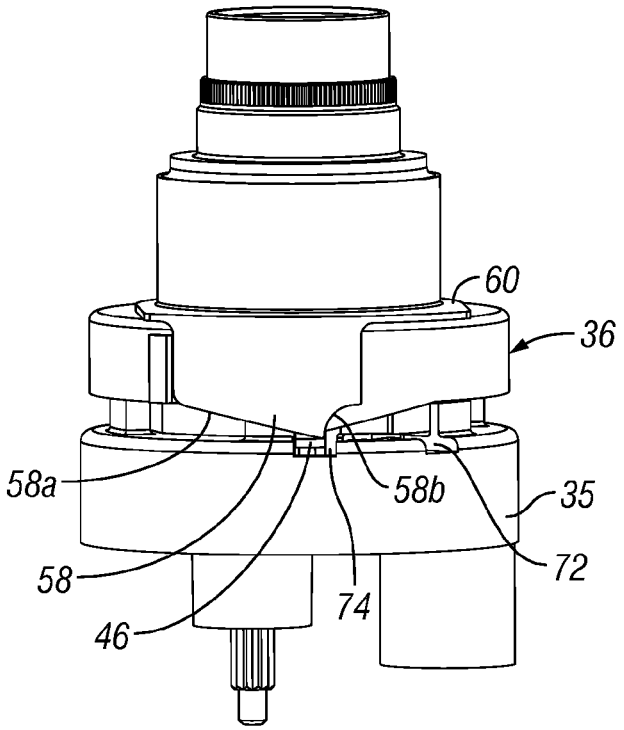

The bull gear assembly 36 includes a downwardly extending fixed arc tab 56 (FIG. 3). A downwardly extending movable arc tab 58 is carried by a bull gear sleeve 60 (FIG. 8). The shift dog 46 is circumferentially movable when alternately engaged by the arc tabs 56 and 58 to actuate the reversing mechanism 32 when the reversing mechanism 32 is driven by the turbine 28. The shift dog 46 is axially movable by the arc tabs 56 and 58 to prevent damage to the reversing mechanism when the nozzle turret 40 is twisted by a vandal. The bull gear sleeve 60 is rotatable via arc adjustment shaft 62 (FIG. 2). The lower end of the arc adjustment shaft 62 has a small pinion gear 64 that engages a nozzle base gear 65 that drives bull gear sleeve 60. The flanged end of the standard HUNTER® tool (not illustrated) may be inserted through a cross-hair aperture 64 (FIG. 1) in the elastomeric top cover 66 of the turret 40 to engage a slotted upper end 68 (FIG. 2) of the arc adjustment shaft 62. See FIG. 8 of the aforementioned U.S. Pat. No. 6,042,021. This allows the shaft 62 to be rotated to change the position of the movable arc tab 58 to thereby pre-set the arc of oscillation of the turret 40 and the nozzle 42 carried therein. Thus a position of the movable arc tab 58 can be adjusted from an upper end of the sprinkler 10.

The arc tabs 56 and 58 (FIG. 3) have a similar saw tooth configuration. The fixed arc tab 56 is formed with a gradually inclined ramp edge 56*a* (FIG. 4) and a curved edge 56*b*. The movable arc tab 58 is similarly formed with a gradually inclined ramp edge 58*a* and an curved edge 58*b*. When the movable arc tab 58 is spaced apart from the fixed arc tab 56, as illustrated in FIGS. 3 and 4 the bull gear assembly 36 will rotate clockwise (viewed from above) until curved edge 58*b* of movable arc tab 58 engages the outer end of shift dog 46, causing it to bend axially downwardly a slight amount and moving the shift dog 46 circumferentially until shift dog plate 48 pivots. This causes the bull gear assembly 36 to rotate in the counter-clockwise direction until the curved edge 56*b* of the fixed arc tab 56 engages the shift dog 46, causing it to bend axially downwardly a slight amount and moving shift dog 46 circumferentially until shift dog plate 48 pivots. This reverses the rotation of the bull gear assembly 36 once again. Should a vandal force the rotation of the turret 40 beyond the pre-set arc limits, the shift dog 46 will engage the arc tabs 56 and 58 one or more times and bend down axially far enough to clear the arc tabs 56 and 58 to thereby prevent damage to any of the mechanisms. Once the vandal releases the nozzle turret 40, the bull gear assembly 36 will once again be rotationally driven by the turbine 28 so that the shift dog 46 engages the inclined edge of one of the arc tabs 56 and 58 and bend downwardly to clear that arc tab. The turret 40 and the nozzle 42 of the sprinkler 10 will then resume oscillation between the original pre-set arc limits. This automatic arc return feature is advantageous in preventing watering of sidewalks, parking lots, and other non-landscape areas which not only wastes water but can present safety hazards to pedestrians.

Figure 7:
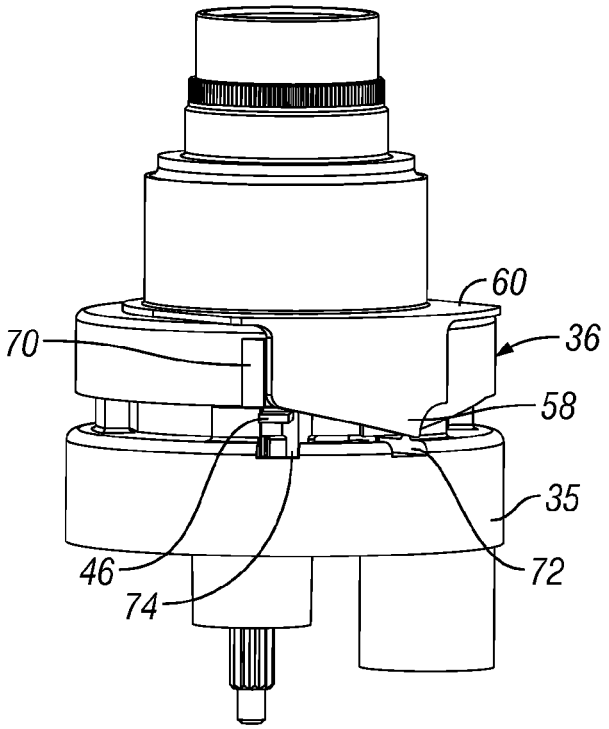
FIGS. 7 and 8 are enlarged perspective views of the bull gear assembly of the sprinkler of FIG. 1 illustrating the manner in which its arc tabs may be overlapped so that the sprinkler will rotate the nozzle in a uni-directional manner through 360°.

The particular configuration of the arc tabs 56 and 58 allows the user to pre-select uni-directional rotation of the turret 40 and nozzle 42 through 360° instead of oscillating motion between pre-set arc limits. This is accomplished by moving the movable arc tab 58 until it circumferentially overlaps with the arc tab 56 as illustrated in FIGS. 7 and 8. This is done using the HUNTER tool to twist the arc adjustment shaft 62 (FIG. 2) until the movable arc tab 58 is stopped from further rotation by engaging fixed stop 70 on the outside surface of bull gear assembly 36. The bull gear assembly 36 then rotates in the counter-clockwise direction and the end of the shift dog 46 rides down ramp edge 56*a* of the fixed arc tab during each revolution. However, because of its gradual taper, insufficient lateral force is exerted on the shift dog plate 48 to shift the reversing mechanism 32. The turret 40 and nozzle 42 thus continue to rotate in a continuous full circle manner in the same direction. Since the reversing mechanism 32 is not shifted during full circle operation unnecessary wear is avoided. Moreover, the angle of the nozzle 42 and/or its ejection orifices can be angled relative to the radius of the sprinkler 10 in order to exert a force that either assists or retards the gear drive.

Figure 9:
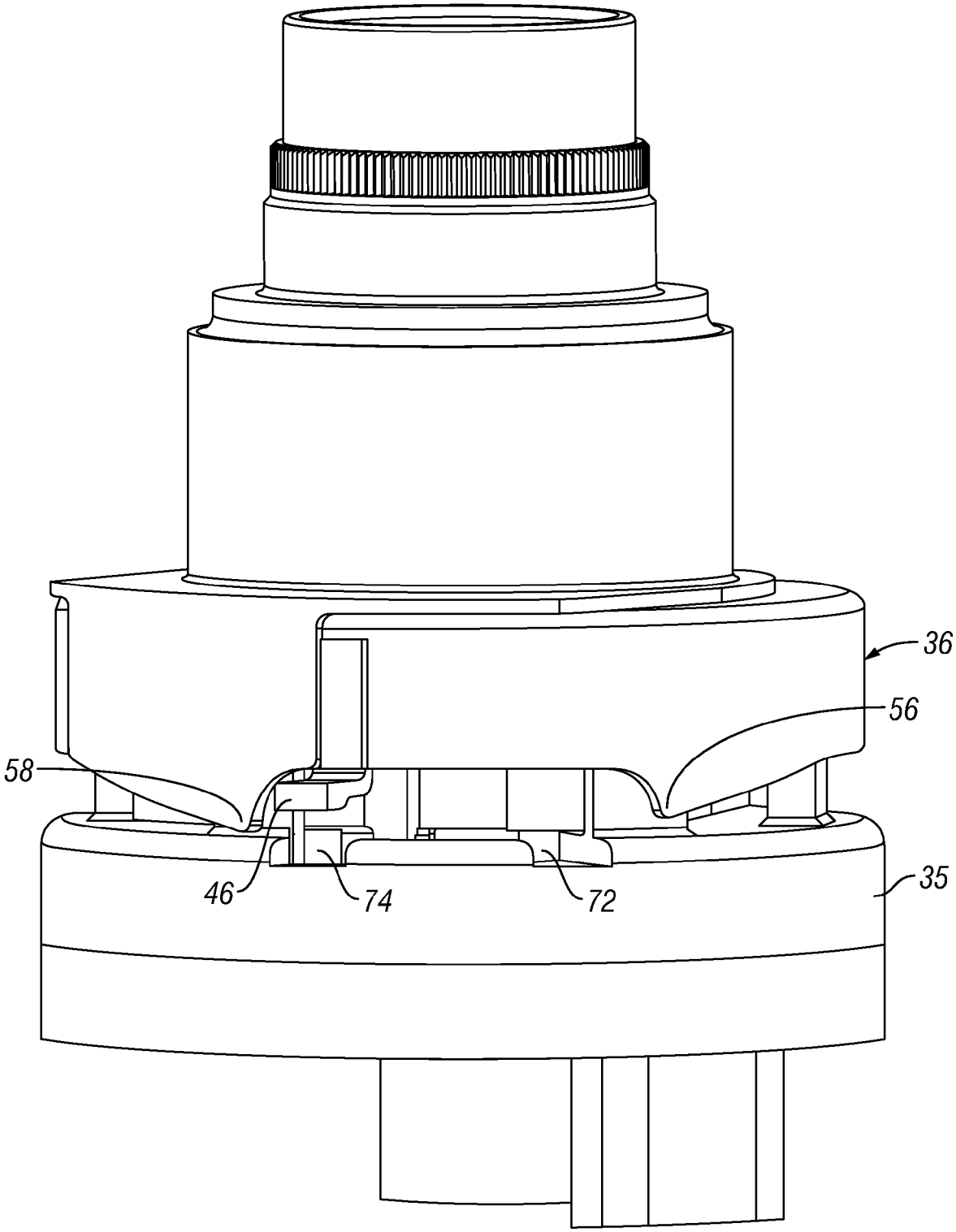
FIGS. 9-19 are a sequence of side elevation views illustrating the operation of the sprinkler of FIG. 1.
Figure 10:
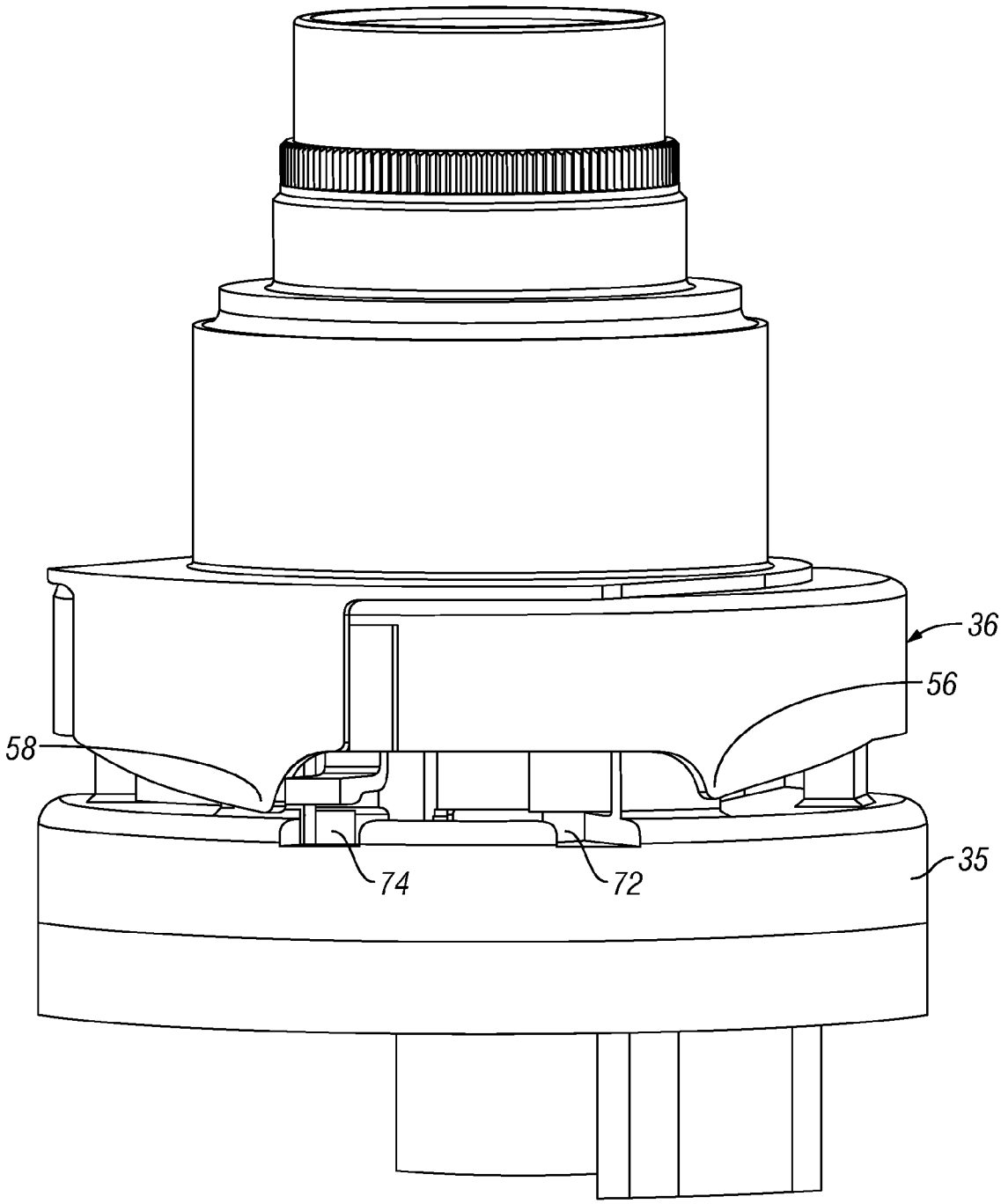

FIGS. 9-19 are a sequence of side elevation views illustrating the operation of the sprinkler of FIG. 1. FIG. 9 illustrates the orientation of the bull gear assembly 36 before either arc tab 56 or 58 has contacted the shift dog 46 during normal operation of the sprinkler 10, i.e. the turbine 28 is driving the turret 40. In FIG. 10 the bull gear assembly 36 has moved counter-clockwise, viewed from the top of the sprinkler 10. Thus the turret 40 is rotating counter-clockwise when viewed from above as in FIG. 1. In FIG. 10, the movable arc tab 58 is initially engaging the resilient flexible shift dog 46 and causing it to deflect only a very minor amount downwardly.

Figure 11:
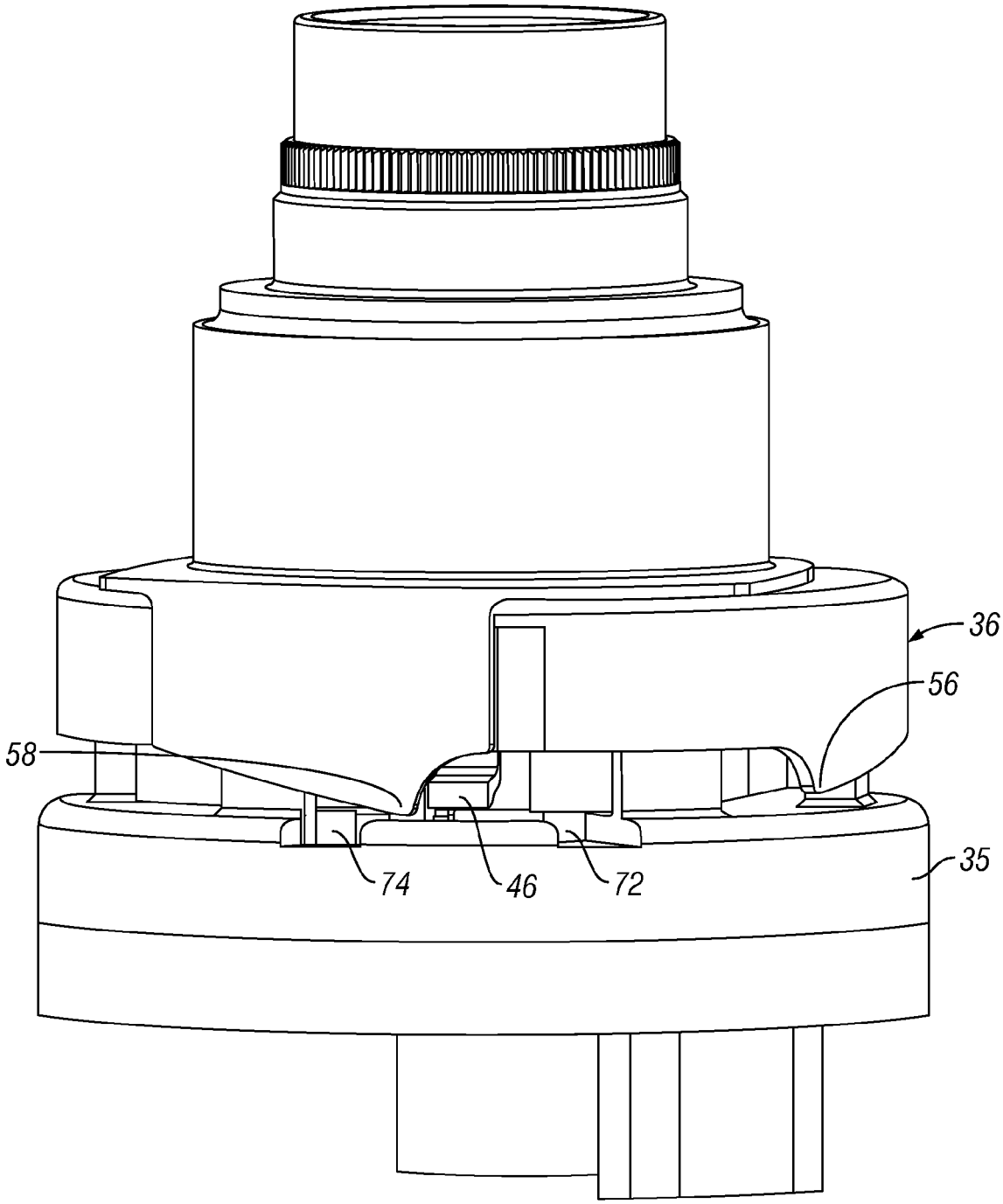
Figure 12:
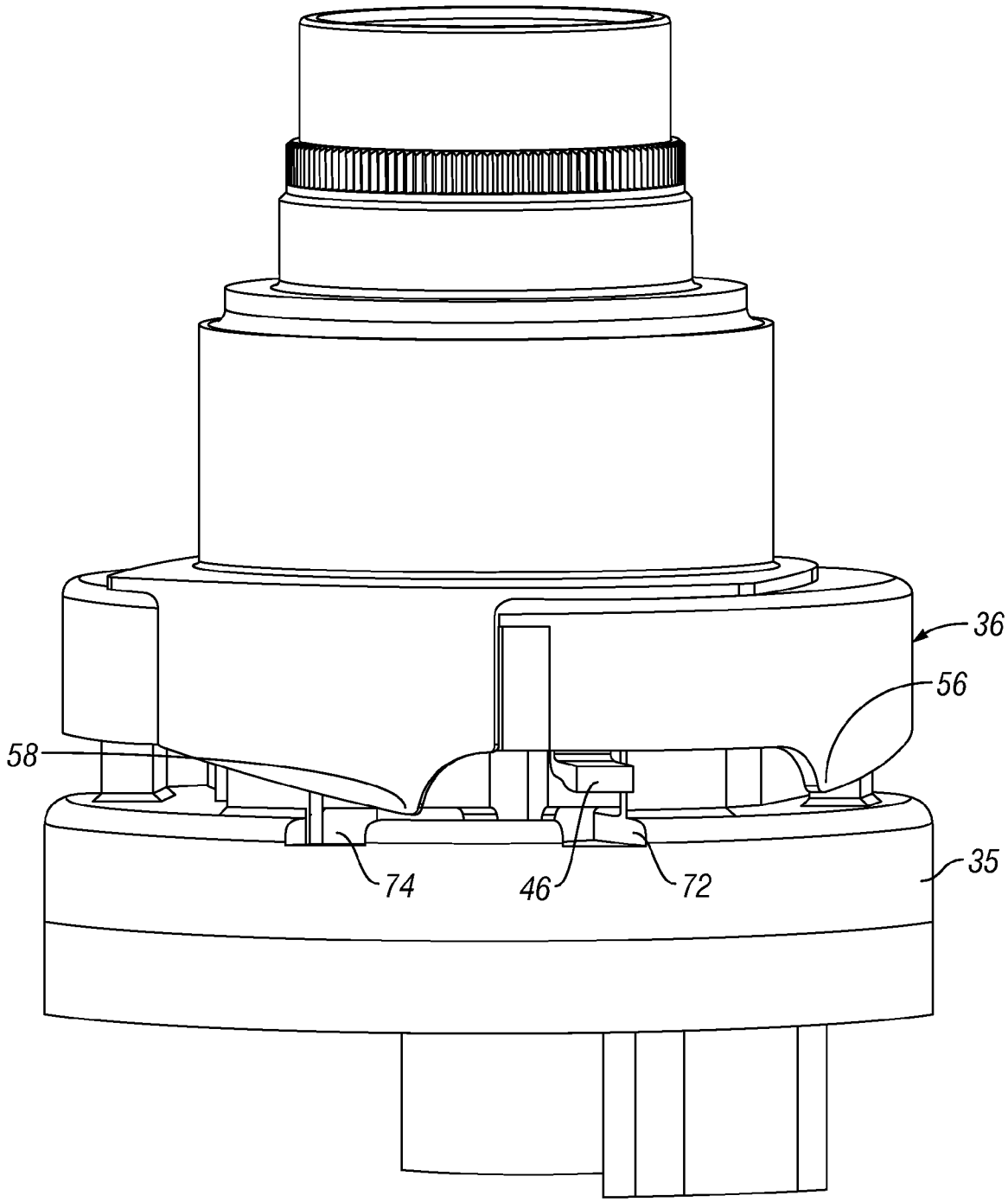

In FIG. 11, the movable arc tab 58 has continued to move in the counter-clockwise direction (to the right in this figure), moving shift dog 46 to the right and actuating the reversing mechanism 32. In FIG. 12, the reversing mechanism 32 has been shifted and has caused the bull gear assembly 36 to rotate in the clock-wise direction, moving the arc tab 58 to the left away from the shift dog 46.

Figure 13:
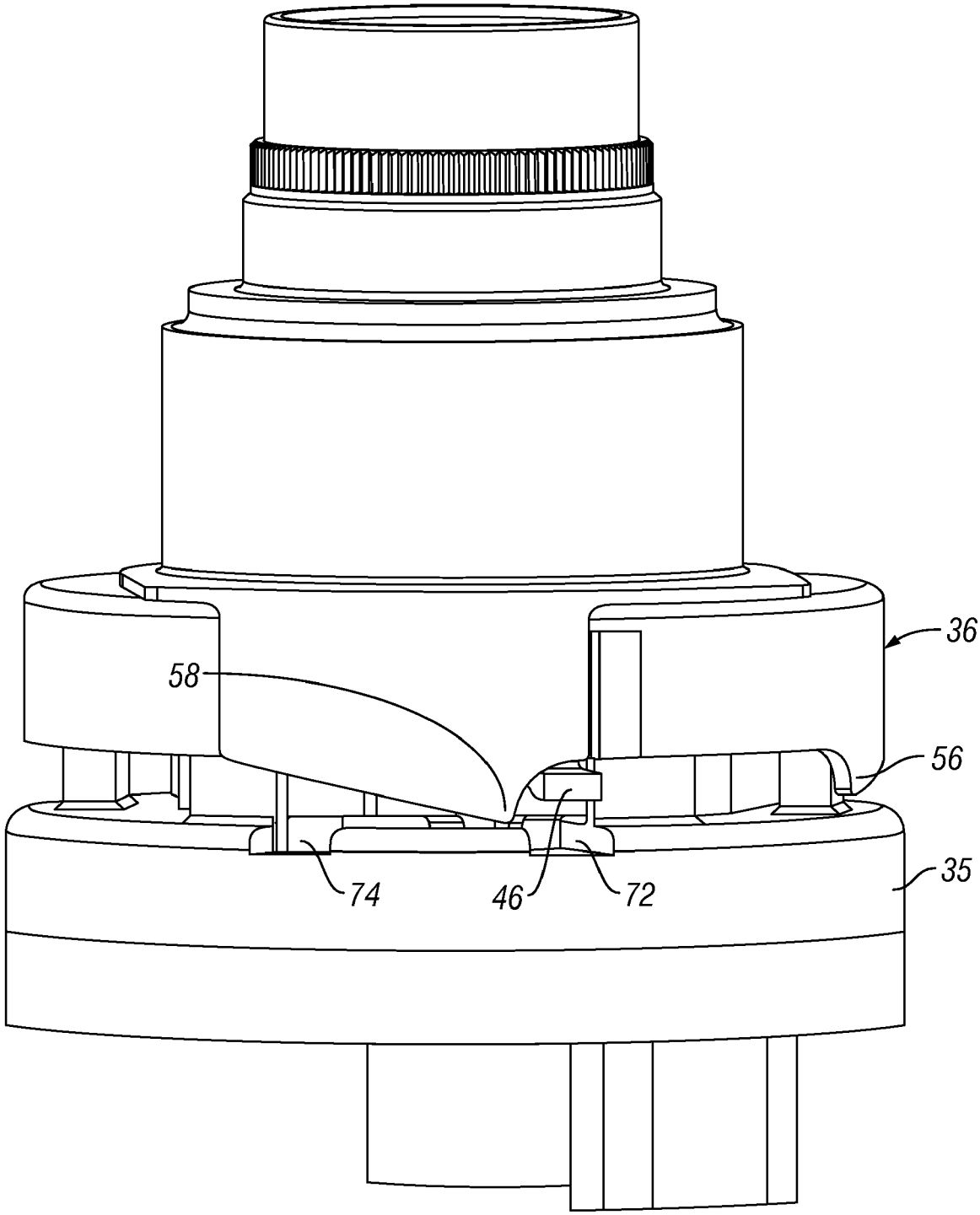
Figure 14:
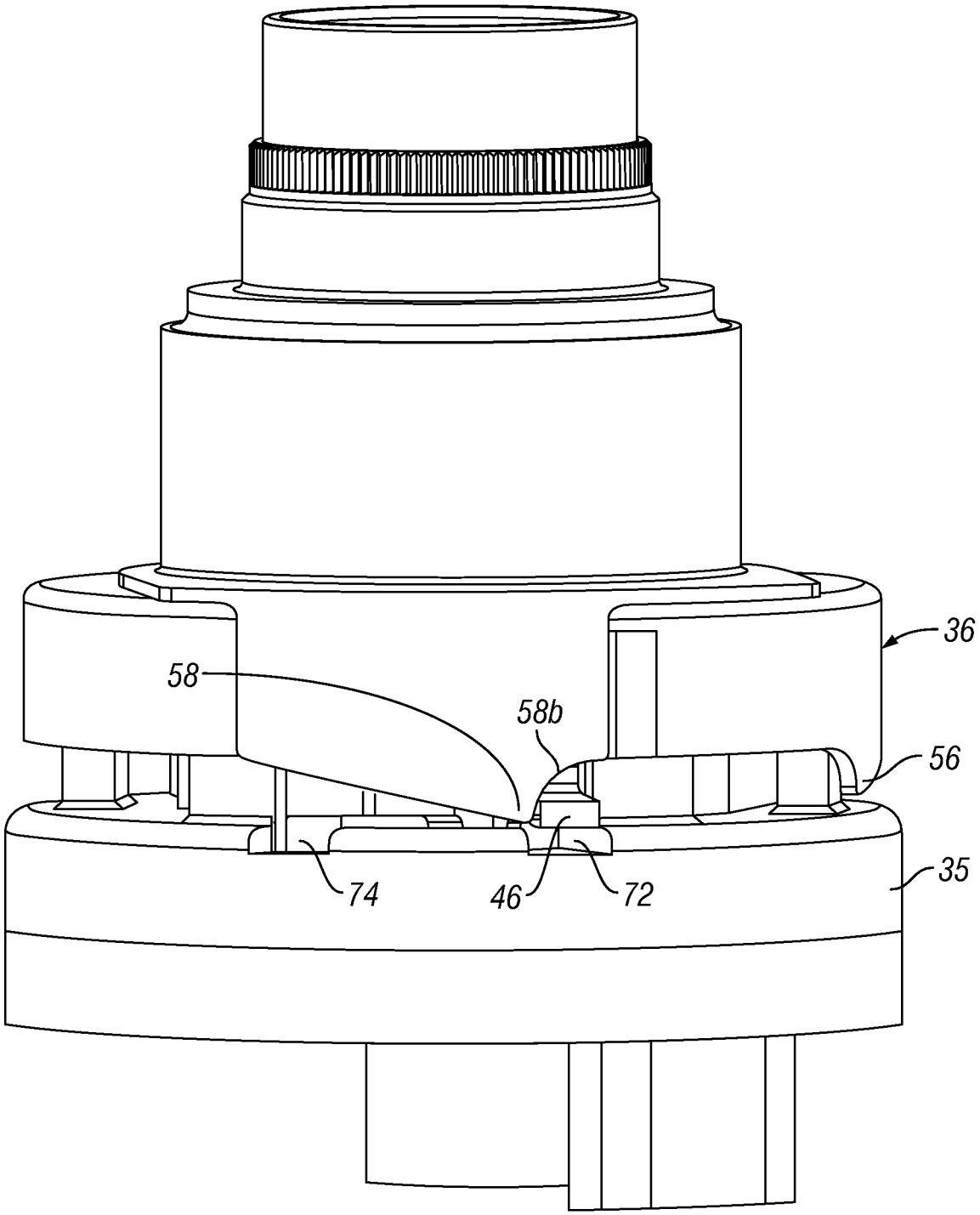

In FIG. 13 a vandal has twisted the turret 40 counter-clockwise when the turret 40 was being driven in the clock-wise direction by the turbine 28 and the shift dog 46 has now been engaged by the movable arc tab 58. In FIG. 14 continued counter-clockwise back-driving of the turret 40 by the vandal causes the curved edge 58*b* of the movable arc tab 58 to deflect the shift dog 46 downwardly.

Figure 15:
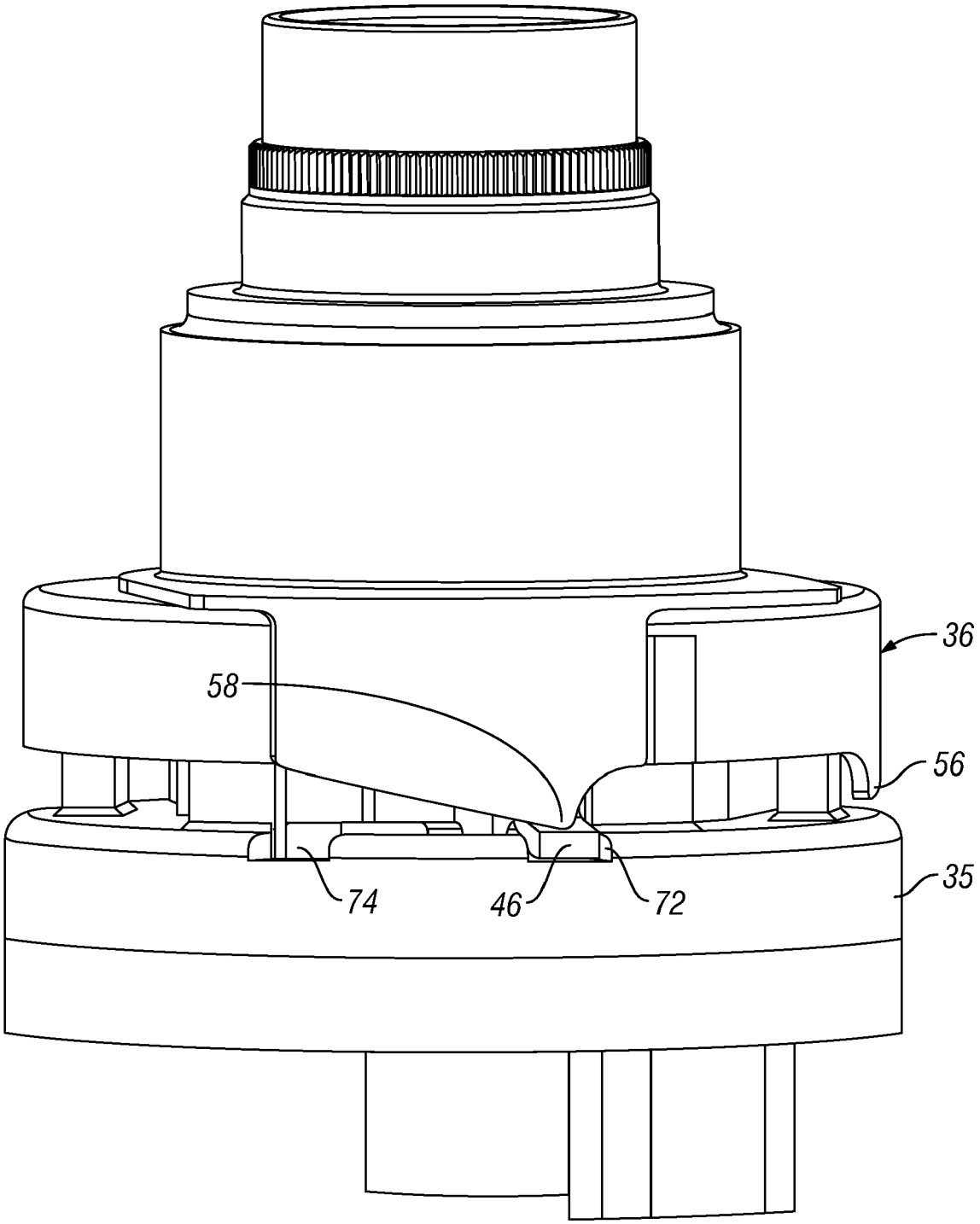
Figure 16:
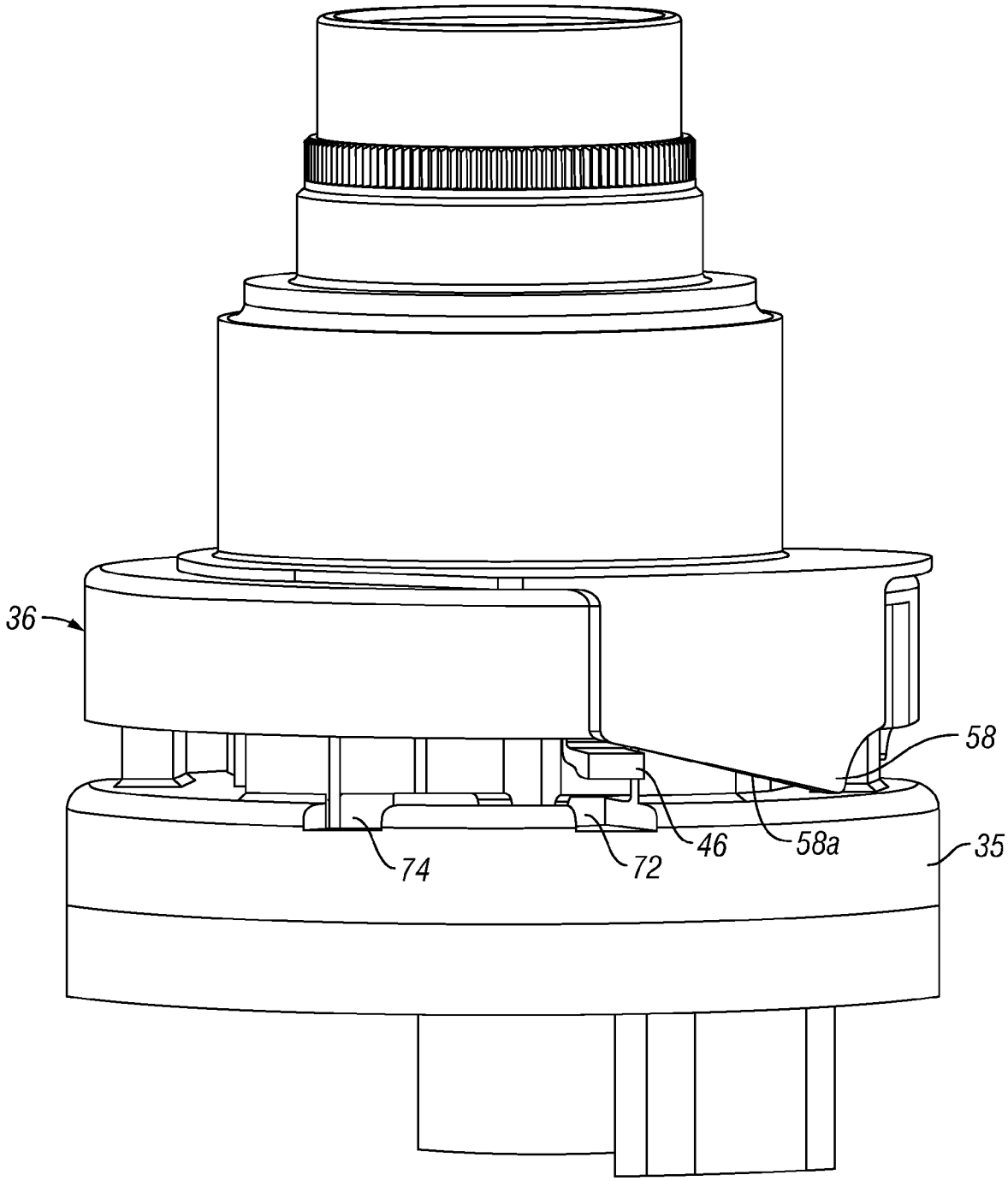

In FIG. 15, continued counter-clockwise back-driving of the turret 40 by the vandal causes the shift dog to be full deflected downwardly into a recess or pocket 72 formed in the partition 35. The rectangular shape of the radially extending pocket 72 is better seen in FIG. 9. When the shift dog 46 is registered or positioned within the pocket 72 it is constrained from being moved laterally and therefore it cannot activate the reversing mechanism 32. In FIG. 16 continued counter-clockwise back-driving of the turret 40 by the vandal moves the movable arc tab further to the right in the figure allowing the resilient flexible shift dog 46 to flex upwardly. The vandal releases the turret 40 and the sprinkler resumes 10 returns to normal operation in which the turbine 28 once again drives the turret 40 in the clock-wise direction. The ramp edge 58*a* is about the contact the shift dog 46.

Figure 17:
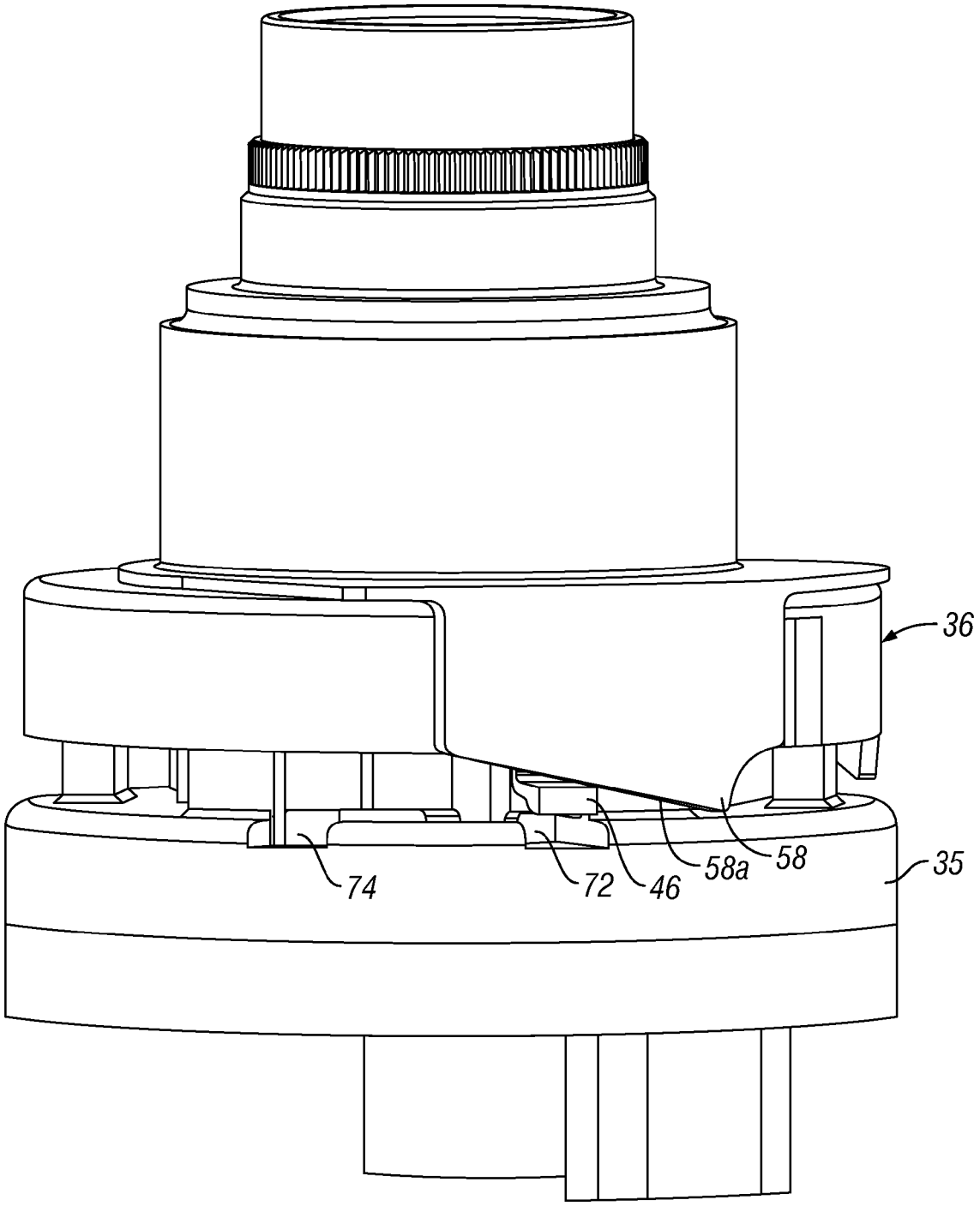
Figure 18:
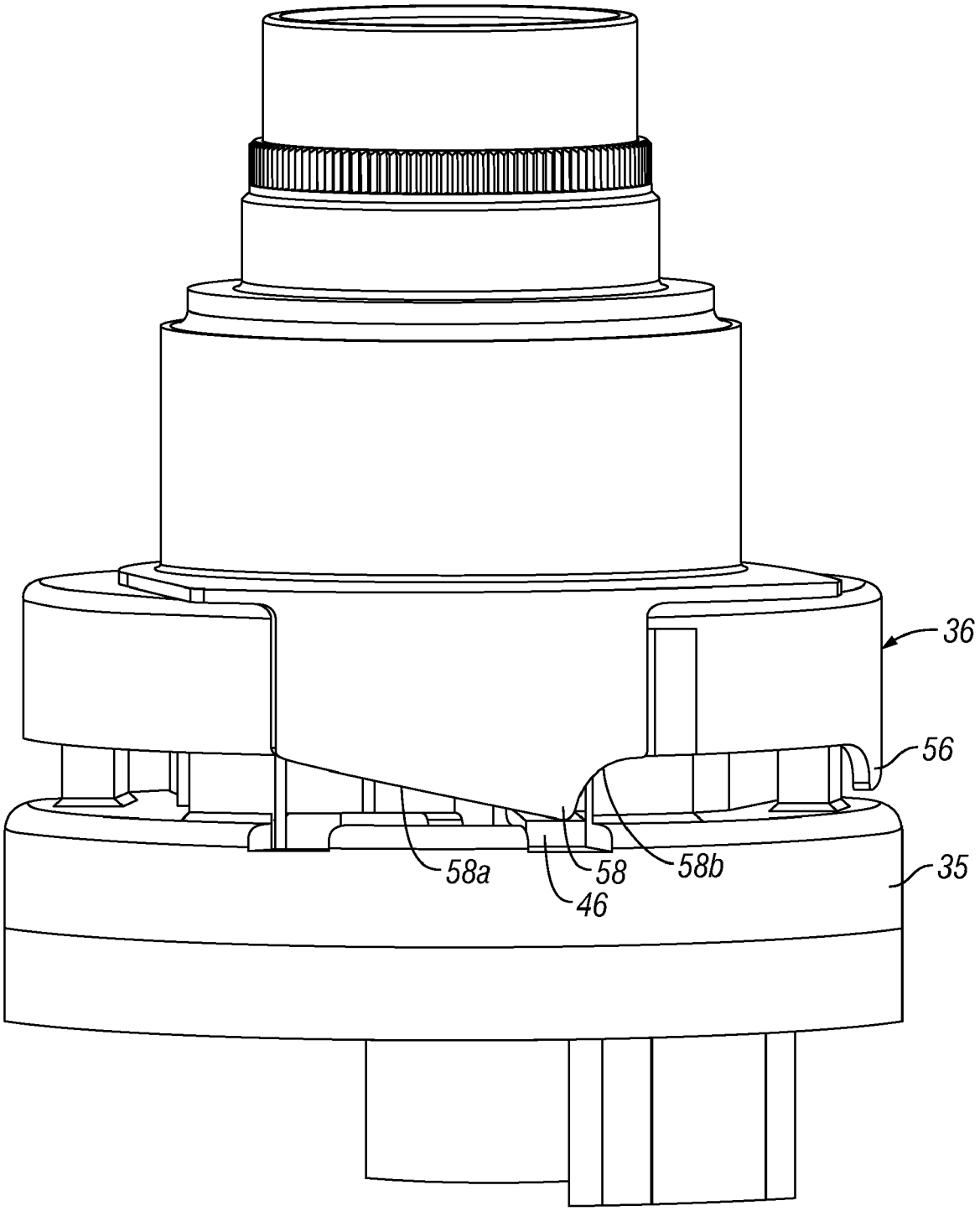

In FIG. 17, continued counter-clockwise driving of the turret 40 by the turbine 28 causes the ramp edge 58*a* of the movable arc tab 58 to engage the shift dog 46 and begin to deflect it downwardly. In FIG. 18, continued counter-clockwise driving of the turret 40 by the turbine 28 causes the shift dog 46 to be fully deflected downwardly into the pocket 72. This prevents the shift dog 46 from inadvertently actuating the shift mechanism 32.

Figure 19:
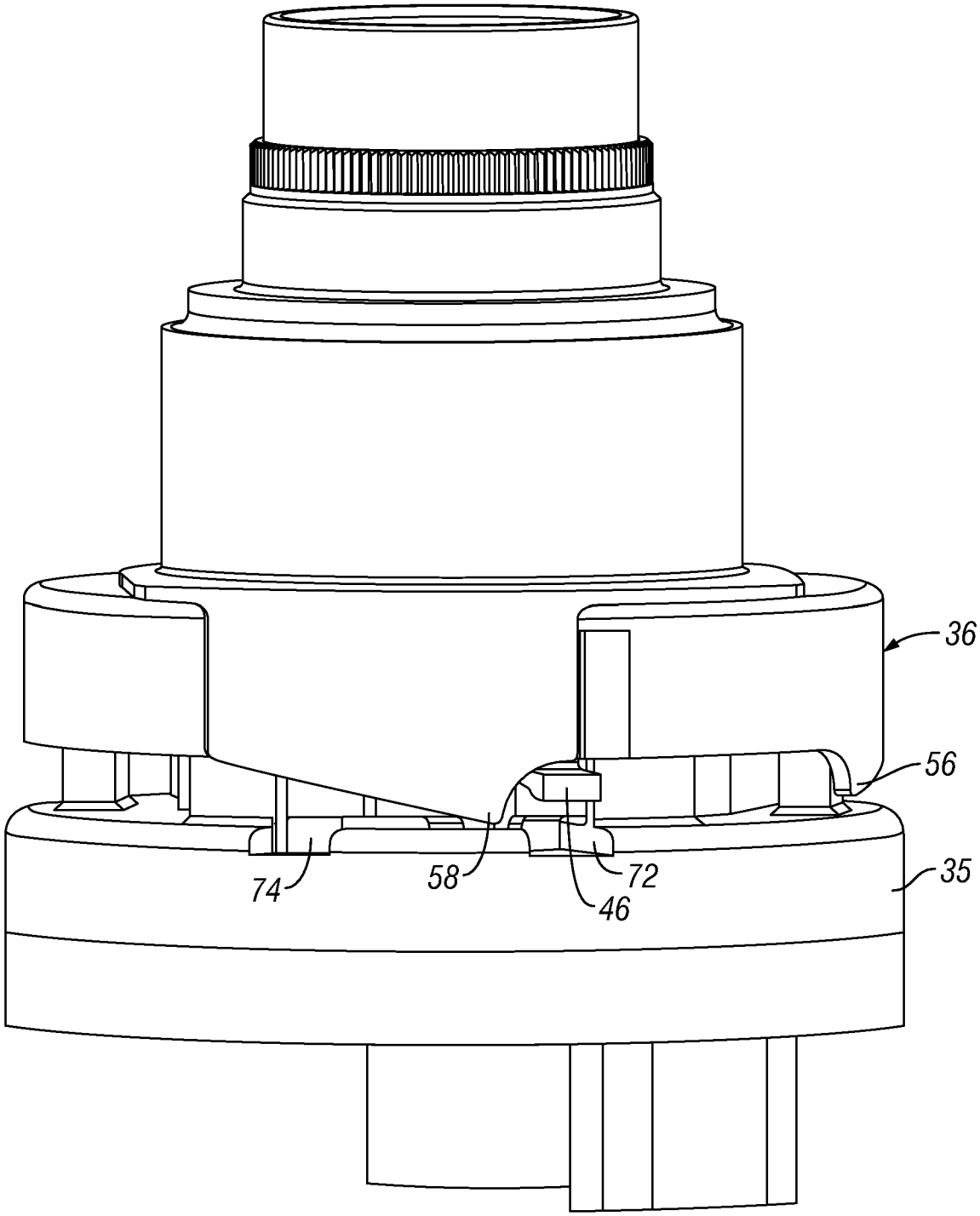

In FIG. 19, continued counter-clockwise driving of the turret 40 by the turbine 28 has moved the movable shift dog 58 further to the left in the figure, allowing the shift dog 46 to bend back upwardly and leave the pocket 72. The turret 40 will now oscillate in the normal fashion between its pre-set arc limits.

As seen in FIGS. 9-19, the partition 35 has a second pocket 74 so that the shift dog 46 can be received therein should a vandal twist the turret 40 clock-wise. The shift dog 46 is deflected downwardly into the pocket 74 when the shift dog 46 is at its left-most position. The curved edge 56*b* of the fixed arc tab 56 engages the shift dog 46 and deflects it downwardly into the pocket 74. Preferably the ramp edges 56*a* and 58*a* and the curved edges 56*b* and 58*b* are undercut to prevent the outer end of the shift dog 46 from being deflected inside the bull gear assembly 36 and inadvertently actuating the reversing mechanism 32.

From the description above, those skilled in the art will appreciate that my invention can be optimized for full circle rotation of the turret 40 (viewed from the top of the sprinkler 10) in either the clockwise or counter-clockwise direction. The movable arc tab 58 can be dimensioned and shaped so that when its left side edge is engaged with the stop 70 (FIG. 7) the tips or points of the arc tabs 56 and 58 will be circumferentially aligned as illustrated in FIGS. 7 and 8 and arc tab 56 extends lower than arc tab 58. The radially inner arc tab 56 will then deflect the shift dog 46 more than the radially outer arc tab 58 which is optimum for counter-clockwise full circle rotation of the turret 40 by the turbine 28. The shift dog 40 will always clear the outer arc tab 58 and there will be no incidental (unintended) shifts or lock-ups. If clockwise full circle operation is desired, then the radially outer arc tab 58 can be sized and dimensioned so that when its left side edge is engaged with the stop 70 its tip is located further to the right in FIG. 7 and so that the tip of the outer arc tab 58 extends lower than the tip of the radially inner arc tab 56. This arrangement is optimum for clockwise full circle operation because it ensures that the radially outer arc tab 58 will deflect the shift dog 40 more than the radially inner arc tab 56 to prevent incidental shifts or lock-ups during clockwise rotation of the nozzle turret 40. The configuration that is optimized for clockwise full circle rotation is the configuration that is illustrated in the drawings. It may be preferable to optimize the configuration for counter-clock wise full circle rotation. Superior results may be achieved if the inner arc tab 56 moves the shift dog 40 downward further than the outer arc tab 58, regardless of whether clockwise or counter-clockwise full rotation is designed into the sprinkler 10.

While an embodiment of the invention has been described in detail, modifications and adaptions thereof will occur to those skilled in the art. For example, both of the arc tabs could be movable, to avoid the need of twisting the riser 12 within the outer housing 14 or adjusting the angular position of the outer housing 14 to align the arc of coverage with the landscaping to be watered. The full circle rotation could be either clockwise or counter-clockwise. The automatic arc return feature is optional. Therefore, the protection afforded the invention should only be limited in accordance with the following claims.

I claim:

1. A sprinkler, comprising:

a riser;

a nozzle for ejecting a stream of water; and a drive mechanism mounted in the riser that allows the nozzle to be manually rotated out of position of a pre-set arc of coverage and automatically return to a normal operation when it is ejecting the stream of water, the drive mechanism including a reversing mechanism having a pivotable set of gears, a pair of arc tabs, the arc tabs formed with a gradual inclined ramp edge and a curved edge, a radially extending resilient flexible shift dog that is moved by the curved edge of the arc tabs to actuate the reversing mechanism to shift the direction of rotation of the nozzle, the outer edge of the shift dog being flexed in an axial direction, by the inclined ramp edge of the arc tabs, to allow the arc tabs to be forced past the shift dog; and at least one over-center spring separate from the shift dog for biasing the pivotable set of gears into one of two positions.

2. The sprinkler of claim 1 wherein the position of at least one of the arc tabs is adjustable from an upper end of the sprinkler.

3. The sprinkler of claim 2 wherein uni-directional full circle rotation of the nozzle can be selected by overlapping the arc tabs.

4. The sprinkler of claim 1 wherein an outermost gear of the pivotable set of gears can alternately engage a bull gear assembly.

5. The sprinkler of claim 1 and further comprising a partition below the reversing mechanism and including a pair of circumferentially spaced pockets for receiving the outer end of the shift dog.

6. The sprinkler of claim 1 wherein the arc tabs have a saw tooth configuration.

7. The sprinkler of claim 1 wherein the arc tabs are shaped to move the outer end of the shift dog circumferentially to actuate the reversing mechanism under a normal drive condition and to deflect the outer end of the shift dog downwardly past the arc tabs when the nozzle is twisted beyond a pair of pre-set arc limits.

8. A sprinkler, comprising:

a riser;

a nozzle for ejecting a stream of water;

a turbine mounted in the riser;

a reversing mechanism mounted in the riser including a pivotable set of gears;

a gear train reduction connecting the turbine and the reversing mechanism;

a bull gear assembly driven by the reversing mechanism including a pair of arc tabs;

an axially extending drive shaft coupling the bull gear assembly and the nozzle;

a radially extending shift dog having an outer end circumferentially movable when engaged by the arc tabs to actuate the reversing mechanism to pivot the set of gears when the reversing mechanism is driven by the turbine and axially flexible to deflect downwardly far enough to clear the arc tabs to prevent damage to the reversing mechanism when the nozzle is twisted beyond a pair of pre-set arc limits;

at least one over center spring separate from the shift dog for biasing the pivotable set of gears into one of two positions; and a partition below the reversing mechanism including a pair of spaced pockets for receiving the outer end of the shift dog when the shift dog is deflected downwardly enough to clear the arc tabs.

9. The sprinkler of claim 8 wherein the reversing mechanism includes a yoke that is moved back and forth by the shift dog.

10. The sprinkler of claim 8 wherein the over-center spring is a U-shaped spring.

11. The sprinkler of claim 8 wherein the arc tabs have a saw tooth configuration.

12. The sprinkler of claim 8 wherein the position of at least one of the arc tabs is adjustable from an upper end of the sprinkler.

13. The sprinkler of claim 8 wherein uni-directional full circle rotation of the nozzle can be selected by overlapping the arc tabs.

14. The sprinkler of claim 8 wherein an outermost gear of the pivotable set of gears can alternately engage a bull gear assembly.

15. The sprinkler of claim 11 wherein the saw tooth configuration includes a gradually inclined ramp edge.

16. The sprinkler of claim 11 wherein the saw tooth configuration includes a curved edge.

* * * * *